US009200356B2

(12) United States Patent
Zurecki et al.

(10) Patent No.: US 9,200,356 B2
(45) Date of Patent: Dec. 1, 2015

(54) APPARATUS AND METHOD FOR REGULATING CRYOGENIC SPRAYING

(75) Inventors: Zbigniew Zurecki, Macungie, PA (US); Robert Ellsworth Knorr, Jr., Allentown, PA (US); John Lewis Green, Palmerton, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 1220 days.

(21) Appl. No.: 11/846,116

(22) Filed: Aug. 28, 2007

(65) Prior Publication Data

US 2008/0048047 A1 Feb. 28, 2008

Related U.S. Application Data

(60) Provisional application No. 60/840,616, filed on Aug. 28, 2006, provisional application No. 60/851,189, filed on Oct. 12, 2006.

(51) Int. Cl.

| | |
|---|---|
| ***A62C 5/02*** | (2006.01) |
| ***B05B 7/12*** | (2006.01) |
| ***B05B 7/06*** | (2006.01) |
| ***B05B 7/04*** | (2006.01) |
| ***F17C 7/02*** | (2006.01) |
| ***F28C 1/00*** | (2006.01) |
| ***C23C 4/12*** | (2006.01) |
| ***F17C 13/00*** | (2006.01) |
| *C21D 1/667* | (2006.01) |

(52) U.S. Cl.

CPC ..... *C23C 4/121* (2013.01); *F17C 13/00* (2013.01); *B05B 7/1281* (2013.01); *C21D 1/667* (2013.01)

(58) Field of Classification Search

CPC .... C23C 4/121; B05B 7/1281; B05B 7/0483; B05B 7/0861

USPC ..... 62/52.1, 121; 239/8, 416.4, 416.5, 239/427.3, 434, 431

See application file for complete search history.

(56) References Cited

U.S. PATENT DOCUMENTS 1,051,905 A * 2/1913 McCord ..... 406/92
2,986,891 A 6/1961 McMahon (Continued)

FOREIGN PATENT DOCUMENTS

CN 200998731 Y 1/2008
DE 1995-3230 A1 5/2001

(Continued)

OTHER PUBLICATIONS

Jones, Paul D. A., et al.; "Control of Temperature Profile for a Spray Deposition Process", IEEE Transactions on Control Systems Technology IEEE USA; vol. 11, No. 5, Sep. 2003; pp. 656-667; XP002392922.

(Continued)

*Primary Examiner* — Allen Flanigan
*Assistant Examiner* — Filip Zec
(74) *Attorney, Agent, or Firm* — Anne R. Kiernan; Rosaleen P. Morris-Oskanian; Amy Carr-Trexler

(57) ABSTRACT

A nozzle and process are set forth for contacting a cryogenic liquid and a gas, and discharging the resulting fluid through the nozzle. In one embodiment, the ratio of the discharged fluid's liquid component to its gaseous component is controlled as a function of the gas pressure.

19 Claims, 11 Drawing Sheets

(56) References Cited

U.S. PATENT DOCUMENTS

| | | | | | |
|---|---|---|---|---|---|
| 3,110,156 | A | | 11/1963 | Niemann | |
| 3,395,548 | A | | 8/1968 | Yearwood | |
| 3,431,745 | A | | 3/1969 | Harper et al. | |
| 3,695,050 | A | | 10/1972 | Bancroft | |
| 3,703,991 | A | * | 11/1972 | Eustis et al. | 239/2.2 |
| 3,830,078 | A | | 8/1974 | Read | |
| 4,011,734 | A | | 3/1977 | Jones | |
| 4,083,220 | A | | 4/1978 | Kobayashi et al. | |
| 4,240,784 | A | * | 12/1980 | Dauvergne | 431/351 |
| 4,252,844 | A | | 2/1981 | Nesgood et al. | |
| 4,262,511 | A | | 4/1981 | Boisvert et al. | |
| 4,392,367 | A | | 7/1983 | Bald | |
| 4,473,186 | A | * | 9/1984 | Alperin | 239/8 |
| 4,498,304 | A | | 2/1985 | Guilhem | |
| 4,749,337 | A | | 6/1988 | Dickinson et al. | |
| 4,753,093 | A | | 6/1988 | Siemon et al. | |
| 4,806,150 | A | | 2/1989 | Alvarez et al. | |
| 4,836,446 | A | * | 6/1989 | Chanel | 239/2.2 |
| 4,857,076 | A | * | 8/1989 | Pearson et al. | 48/86 R |
| 4,874,560 | A | * | 10/1989 | Titmas | 261/76 |
| 5,134,961 | A | | 8/1992 | Giles et al. | |
| 5,188,296 | A | * | 2/1993 | Duez et al. | 239/403 |
| 5,242,474 | A | | 9/1993 | Herbst et al. | |
| 5,250,780 | A | | 10/1993 | Hansz et al. | |
| 5,327,763 | A | | 7/1994 | Kramer et al. | |
| 5,344,478 | A | | 9/1994 | Zurecki et al. | |
| 5,385,025 | A | | 1/1995 | Kellett et al. | |
| 5,517,842 | A | | 5/1996 | Ginzburg | |
| 5,730,806 | A | | 3/1998 | Caimi et al. | |
| 5,738,281 | A | | 4/1998 | Zurecki et al. | |
| 5,755,128 | A | | 5/1998 | Tippins et al. | |
| 5,799,523 | A | | 9/1998 | Seidel et al. | |
| 5,942,037 | A | * | 8/1999 | Wagener et al. | 118/315 |
| 5,989,647 | A | | 11/1999 | Remy et al. | |
| 6,070,416 | A | | 6/2000 | Germain et al. | |
| 6,093,310 | A | * | 7/2000 | Swan | 208/113 |
| 6,202,525 | B1 | | 3/2001 | Hendrickson et al. | |
| 6,226,996 | B1 | * | 5/2001 | Weber et al. | 62/126 |
| 6,363,729 | B1 | | 4/2002 | Brahmbhatt et al. | |
| 6,378,778 | B1 | * | 4/2002 | Lurås | 239/14.2 |
| 6,648,053 | B2 | | 11/2003 | Allor et al. | |
| 6,675,622 | B2 | | 1/2004 | Plicht et al. | |
| 6,740,624 | B1 | | 5/2004 | Hoste et al. | |
| 6,860,950 | B2 | | 3/2005 | Franz et al. | |
| 6,874,344 | B1 | | 4/2005 | Junius et al. | |
| 6,916,416 | B2 | * | 7/2005 | Adamson et al. | 208/113 |
| 7,054,764 | B2 | | 5/2006 | Williams et al. | |
| 7,167,099 | B2 | | 1/2007 | Kadwell et al. | |
| 7,252,024 | B2 | | 8/2007 | Zurecki et al. | |
| 2002/0013925 | A1 | | 1/2002 | Senshu | |
| 2002/0139125 | A1 | | 10/2002 | Kunkel et al. | |
| 2002/0189413 | A1 | | 12/2002 | Zurecki et al. | |
| 2004/0001182 | A1 | | 1/2004 | Dyner | |
| 2004/0109692 | A1 | | 6/2004 | Plante | |
| 2004/0245373 | A1 | | 12/2004 | Behrens | |
| 2005/0011201 | A1 | | 1/2005 | Zurecki et al. | |
| 2005/0160615 | A1 | | 7/2005 | Wang et al. | |
| 2006/0029742 | A1 | | 2/2006 | Cesak et al. | |
| 2006/0220888 | A1 | | 10/2006 | Germouni et al. | |
| 2006/0228465 | A1 | | 10/2006 | Zurecki | |
| 2007/0084263 | A1 | | 4/2007 | Zurecki | |
| 2007/0164130 | A1 | | 7/2007 | Jackson | |

FOREIGN PATENT DOCUMENTS

| | | | |
|---|---|---|---|
| EP | 0 136 921 | A2 | 4/1985 |
| EP | 0 249 186 | A1 | 12/1987 |
| EP | 0249186 | A1 | 12/1987 |
| EP | 0 610 300 | B1 | 5/1996 |
| EP | 0 960 955 | A1 | 12/1999 |
| EP | 1 038 987 | B1 | 12/2003 |
| FR | 1564042 | A | 4/1969 |
| GB | 1418400 | | 12/1975 |
| GB | 2 199 263 | A | 7/1988 |
| GB | 2294217 | A | 4/1996 |
| JP | 02-066415 | A | 3/1990 |
| JP | 05-050121 | | 3/1993 |
| JP | 08117644 | A | 5/1996 |
| JP | 2000-210837 | A | 8/2000 |
| JP | 2001-096301 | | 4/2001 |
| JP | 2006337326 | | 12/2006 |
| SU | 710705 | | 1/1980 |
| WO | WO 8912116 | | 12/1989 |
| WO | WO 9318869 | | 9/1993 |
| WO | 97/19773 | A1 | 5/1997 |
| WO | 97/19773 | | 6/1997 |
| WO | 97/19773 | A1 | 6/1997 |
| WO | WO 9826104 | | 6/1998 |
| WO | WO 9961674 | | 12/1999 |
| WO | WO 0075558 | A2 | 12/2000 |
| WO | WO 02083971 | A1 | 10/2002 |
| WO | WO 02083972 | A1 | 10/2002 |
| WO | WO 02087803 | A1 | 11/2002 |
| WO | WO 03035322 | A1 | 5/2003 |
| WO | WO 2006074875 | B1 | 7/2006 |

OTHER PUBLICATIONS

Jones, P.D.A., et al., "Estimating the Surface Temperature Profile from a Sequence of Partial Thermal Images"; Proceedings of the SPIE—The International Society for Optical Engineering SPIE—Int. Soc. Opt. Eng., USA; vol. 4571; 2001 pp. 199-207; XP002392923.

Pathirana, Pubudu, et al., "Control of Average Temperature in a Spray Deposition Process", IEEE Conf. Control Appl. Proc; IEEE Conference on Control Applications Proceedings 2002; vol. 2; pp. 1004-1009; XP 002392924.

Nuse, J.D. et al., "Surface Finishing of Tungsten Carbide Cobalt Coatings Applied by HVOF for Chrome Replacement Applications", Aerospace/Airline Plating and Metal Finishing Forum, Mar. 27, 2000, pp. 1-12, Cincinatti, OH.

Stokes, J., et al., "HVOF System Definition to Maximise the Thickness of Formed Components", Proceedings of the International Conference on Advances in Materials and Processing Technologies (AMPT '99). Dublin, Ireland, Aug. 3-6, 1999, pp. 775-784.

Lucchese, P., et al., "Optimization of Robotic Trajectories in the Atmosphere and Temperature Controlled Plasma Spray Process on Ceramic Substrate Using Heat Flow Modelling", Proceedings of the 1993 National Thermal Spray Conference, Jun. 7-11, 1993, pp. 231-239, Anaheim, CA.

Nguyen, T., et al., "An Assessment of the Applicability of Cold Air and Oil Mist in Surface Grinding", Journal of Materials Processing Technology 140, 2003, pp. 224-230, Sydney, Australia.

Yang, Y.P., et al., "A Hot-Cracking Mitigation Technique for Welding High-Strength Aluminum Alloy", Welding Research Supplement, Jan. 2000, pp. 9s-17s.

Brian M. Pikkula et al., "Cryogen Spray Cooling: Effects of Droplet Size and Spray Density on Heat Removal," Lasers in Surgery and Medicine, 28:103-112 (2001).

* cited by examiner

APPARATUS AND METHOD FOR REGULATING CRYOGENIC SPRAYING

CROSS-REFERENCE TO RELATED APPLICATIONS

This application claims the benefit of Provisional U.S. Application No. 60/840,616 filed Aug. 28, 2006, and 60/851189 filed Oct. 12, 2006, both entitled "Nozzle, System, and Method for Cryogenic Impingement" which are incorporated in their entirety herein by reference.

BACKGROUND

The present invention relates to a cryogenic nozzle. In particular, the present invention relates to controlling the flow rate of a cryogenic liquid through a cryogenic nozzle. A nozzle is a constriction of the fluid line at or near the exit or termination point from which that fluid is ejected into open space that is at a lower pressure than the pressure in the supply line. The fluid passages shown in FIGS. 1C, 2A-2D and 3 are the constrictions within the nozzle and those figures do not show the supply lines to the nozzle.

FIG. 1A shows the conventional method for controlling the flow rate of a cryogenic liquid through a nozzle. In particular, a valve V is installed upstream of the nozzle that restricts the flow of the cryogenic liquid L when the desired flow rate through nozzle N is less than the design capacity of the nozzle. A problem with this conventional method is the pressure drop the liquid incurs across the valve which causes a reduction in the spray velocity.

Furthermore, the pressure drop causes a portion of the liquid to boil downstream of the valve which can plug the nozzle and/or the nozzle passage, thereby causing flow rate pulsations. It is important to understand in this regard that the conventional method is constrained from increasing the size of the nozzle orifice to quickly vent the boil-off and thus eliminate the resulting flow rate pulsations. In particular, a larger nozzle orifice in the conventional method would require a higher degree of valve restriction to achieve an equivalent range of flow reductions, and thus a larger pressure drop and even more boil-off.

This constraint on increasing the nozzle size in the conventional method leads to another problem in the conventional method when the nozzle and the delivery line thereto must be cooled down from room temperature before start-up. In particular, an oversized nozzle is required to quickly vent the large quantities of vapor that evolve during such a cool-down. Consequently, the conventional method is faced with the dilemma of choosing between the time-consuming task of changing out the oversized nozzle before commencing normal operation, or the complexities of designing a system for temporarily increasing the orifice size of the nozzle during cool-down.

Finally, another problem with the conventional method is the valve itself. In particular, valves that must handle cryogenic liquids are costly and tend to break down. The present invention provides a method for controlling the flow rate of a cryogenic liquid through a nozzle that avoids the above described problems.

FIG. 1B shows a conventional modification to FIG. 1A to reduce the boiling-induced flow rate pulsations by locating valve V at nozzle N. In this fashion, the boiling occurs in the nozzle discharge and thus associated nozzle plugging is avoided. Unfortunately, this modification would be impractical in many applications as the controlling valve makes the nozzle too big and bulky to fit in manufacturing machines.

Furthermore, moving the pressure drop to the nozzle discharge does not prevent the reduction in the spray velocity from occurring.

Related art includes Kellett, U.S. Pat. No. 5,385,025; Brahmbhatt et al, U.S. Pat. No. 6,363,729; Germain et al, U.S. Pat. No. 6,070,416; and Kunkel et al, US 2002/0139125.

BRIEF SUMMARY OF THE INVENTION

The present invention is a method and apparatus for controlling the flow rate of a cryogenic liquid through a nozzle. The flow rate is controlled with a "throttling" gas having a pressure greater than or equal to the pressure of the cryogenic liquid, a temperature greater than the temperature of the cryogenic liquid; and a boiling point less than or equal to the temperature of the cryogenic liquid.

Specifically this invention provides a process comprising providing a cryogenic liquid; providing a throttling gas having a pressure greater than or equal to the pressure of the cryogenic liquid, a temperature greater than the temperature of the cryogenic liquid; and a boiling point less than or equal to the temperature of the cryogenic liquid; introducing the cryogenic liquid and the throttling gas into a contact zone and contacting the liquid and the throttling gas to form a resulting fluid; and discharging the fluid through a nozzle while continuing to introduce the cryogenic liquid and the throttling gas into the contact zone. The method includes the step of continuing the gas and liquid flows for a period of time and adjusting the mass flow rate, and/or temperature, and/or pressure of the gas as desired between from maximum flow to no gas flow to adjust or maintain the mass flow rate of the cryogenic liquid.

In the process of the present invention, the cryogenic liquid and throttling gas are introduced into a contact zone where they are contacted to form a resulting fluid. The resulting fluid is discharged through the nozzle while continuing to introduce additional cryogenic liquid and throttling gas or additional cryogenic liquid, or additional throttling gas, from one or more sources upstream of the contact zone, into the contact zone. In one embodiment of the process of the present invention, the process further comprises controlling the fluid's discharge mass flow rate and the mass ratio of the discharged fluid's liquid component to its gaseous component as a function of the throttling gas pressure.

In one embodiment of the present invention, the apparatus comprises a conduit having an upstream end and a downstream end in head-on flow communication with a nozzle. The apparatus further comprises a first supply line that connects a pressurized gas supply line to the conduit and a second supply line that connects the cryogenic liquid supply line to the conduit. The discharge end of the gas supply line is in head-on flow communication with the upstream end of the conduit, while the liquid supply line is in 45-135 degree flow communication with the upstream end of the conduit (measured from the conduit).

In a second apparatus embodiment of the present invention, the apparatus comprises a conduit having a first feed end and a second feed end which may be an opposing feed end, and a nozzle comprising a row of openings (or optionally a slit) along at least a portion of the length of the wall of the conduit. The apparatus further comprises a first supply line having a discharge end in head-on flow communication with at least one of the feed ends of the conduit, and a second supply line having a discharge end in 45-135° flow communication with at least one of the feed ends of the conduit. The angle is measured from the conduit. In one embodiment of the second apparatus, the first supply line that is in head-on communication with the conduit connects a pressurized gas supply to the conduit, while the second supply line that is in 45-135° flow communication or 90-135° flow communication with the conduit connects a cryogenic liquid supply to the conduit.

In a third apparatus embodiment of the present invention, the apparatus comprises an annular space defined by an outer conduit concentrically surrounding an inner conduit containing a plurality of openings in its wall. The annular space has a first feed end and an opposing feed end which are respectively adjacent to a first inlet end and an opposing inlet end of the inner conduit. The apparatus further comprises a nozzle comprising a row of openings (or optionally a slit) along at least a portion of the length of the wall of the outer conduit, a first supply line in flow communication with at least one of the feed ends of the annular space, and a second supply line in flow communication with at least one of the inlet ends of the inner conduit. In one embodiment of the third apparatus, the first supply line in flow communication with annular space connects a pressurized gas supply to the annular space, while the second supply line in flow communication with the inner conduit connects a cryogenic liquid supply to the inner conduit.

This invention further provides an apparatus comprising at least one cryogenic spray device each having at least one gas inlet in fluid communication with a contact zone; and at least one cryogenic liquid inlet in fluid communication with the contact zone, the contact zone being in fluid communication with at least one nozzle; and a gas supply control in fluid communication with each of the at least one gas inlet; wherein the gas supply control is adapted to enable adjustment of at least one of temperature and pressure of gas supplied to each of the at least one gas inlet to achieve a first desired flow rate of cryogenic liquid through the at least one nozzle when a source of cryogenic liquid at a first pressure is provided to each of the at least one cryogenic liquid inlet.

This invention further provides an apparatus comprising: an outer conduit; an inner conduit positioned within the outer conduit and defining an annular space between the outer conduit and the inner conduit, the inner conduit having at least one opening positioned to enable the cryogenic liquid to flow radially from the inner conduit into the annular space; at least one nozzle formed on the outer conduit, each of the at least one nozzle being in fluid communication with the annular space; a first gas inlet in fluid communication with the outer conduit, the first gas inlet being adapted to be connected to a pressurized gas supply; and a first cryogenic liquid inlet in fluid communication with the inner conduit, the first cryogenic liquid inlet being adapted to be connected to a cryogenic liquid supply.

This invention further provides an apparatus comprising: a conduit having an upstream end and a downstream end; a nozzle in head-on flow communication with the downstream end; a first inlet that is adapted to be connected to a pressurized gas supply line, the first inlet having a discharge end in head-on flow communication with the upstream end of the nozzle; and a second inlet that is adapted to connect to a cryogenic liquid supply line, the second inlet having an outlet end in 45-135 degree flow communication with the upstream end.

This invention further provides a method comprising: supplying a cryogenic liquid at a first pressure and first temperature to a contact zone that is in fluid communication with at least one nozzle; supplying a gas at a second pressure and second temperature to the contact zone, the second pressure being no less than the first pressure, the second temperature being greater than the first temperature, and the gas having a boiling point at 1 atm that is no greater than the first temperature; regulating the gas supplied to the contact zone in order to achieve a desired flow rate of cryogenic liquid through each of the at least one nozzle.

DETAILED DESCRIPTION OF THE INVENTION

Figure 1A:
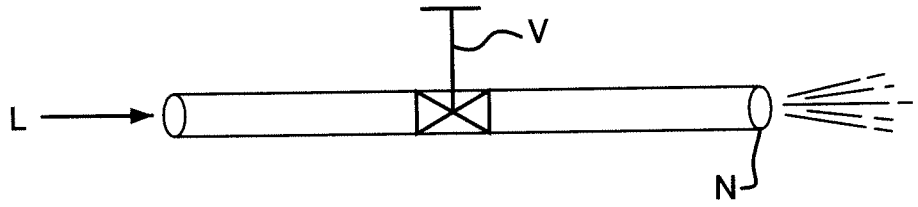
FIG. 1A (Prior Art)
FIG. 1A shows a conventional cryogenic spray nozzle.
Figure 1B:
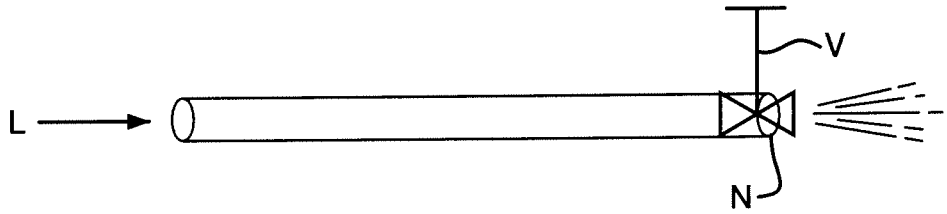
FIG. 1B (Prior Art)
FIG. 1B shows a conventional cryogenic spray nozzle with a modified location.

As used herein and in the claims, the following terms shall be defined as follows:

(i) A "cryogenic fluid" means a fluid having a boiling point less than −73° C. at 1 atm pressure.

(ii) A "cryogenic liquid" means a cryogenic fluid in liquid phase a boiling point less than −73° C. at 1 atm pressure.

(iii) A "nozzle" shall mean one or more openings for discharging a fluid. A nozzle is a constriction of the fluid line at or near the exit or termination point from which that fluid is ejected into open space that is at a lower pressure than the pressure in the supply line.

(iv) "Head-on" flow communication between a conduit and a nozzle shall mean the flow path at the discharge end of the conduit merges into the flow path through the nozzle without a change in direction. Similarly, "head-on" flow communication between a fluid and a conduit shall mean the flow path of the fluid merges into the flow path at the feed or upstream end of the conduit without a change in direction. Finally, "head-on" flow communication between a supply line and a conduit shall mean the flow path at the discharge end of the supply line merges into the flow path at the feed or upstream end of the conduit without a change in direction.

(v) "45°-135° flow communication" between a fluid and a conduit shall mean the flow path of the fluid merges into the flow path at the feed end of the conduit at an angle from 45° to 135°. Similarly, 45°-135° flow communication between a supply line and a conduit shall mean the flow path at the discharge end of the supply line merges into the flow path at the feed end of the conduit at an angle from 45° to 135°. For some embodiments the direction of the flow of the gas into the liquid into the contact zone of the nozzle, as defined by openings, supply lines or other connections, is from 0° to 180°, 0° to 90° or 45° to 90°, and the conduit may or may not be in head on flow communication with the contact zone.

The present invention is based on Applicants' discovery that when a cryogenic liquid and a pressurized "throttling"

gas are introduced into a "contact zone" and the resulting fluid discharged through a nozzle, the discharged fluid's liquid-to-gaseous ratio, and therefore the flow rate of cryogenic liquid, can be controlled as a function of the pressure of the throttling gas. In this fashion, the present invention can alternate between an impingement cooling functionality, when the discharge fluid may comprise a majority (51-100%) or higher percentage up to 100% liquid (for example, 75-100% liquid) and a blast-cleaning functionality when the discharge fluid may comprise a majority (51-100%) or higher percentage up to 100% gas (for example, 75-100% gas), without any changes other than to the pressure of the throttling gas (hereafter, the "hybrid functionality" feature).

Furthermore, in a "spray tube" embodiment of the present invention, Applicants have developed a method for controlling the "spray profile" of the discharged fluid's liquid component as a function of the throttling gas pressure (hereafter, the "spray profile" feature). In this fashion, the present invention can match a substrate's "cooling profile" (such as in a cold rolling application where the middle of the metal strip requires more cooling than the ends) or even track a dynamic heat load that is imparted to a substrate (such as in a thermal spraying application, for example, disclosed in "Thermal Deposition Coating Method" Ser. No. 11/389,308 filed Mar. 27, 2006, claiming priority to provisional application 60/670,497, filed Apr. 12, 2005, entitled "Control Method for Thermal Deposition Coating Operations, which are both incorporated herein in their entireties by reference herein.

In general, increases in the throttling gas pressure between a pressure equal to the cryogenic liquid pressure and a maximum gas pressure result in proportional decreases in the discharged fluid's liquid-to-gaseous ratio. The composition of the discharge fluid may vary between 100 percent liquid to 100 percent gas. Such increases in the gas pressure will result in a proportional decrease in the total mass flow rate of the discharged fluid. These relationships are discussed in more detail below.

An important advantage of the present invention is ability to control the discharged fluid's liquid component is achieved without a conventional flow-restricting valve and the associated pressure drop. Consequently, unlike the conventional methods, the liquid spray velocity in the present invention does not decay as the liquid component of the discharge is reduced (hereafter, the "spray velocity" feature).

Another important consequence of the absence of the conventional flow-restricting valve in the present invention is the ability to use larger nozzle sizes than are possible with conventional methods. Consequently, the nozzle can be increased to a size that will quickly respond to gas pressure increases in terms of achieving the desired liquid-to-gaseous discharge ratio (hereafter, the "rapid response" feature). Moreover, this increased nozzle size also functions to quickly vent the large quantities of vapor that are generated when the system must be started-up from ambient temperature (hereafter, the "rapid start-up" feature).

The above hybrid functionality, spray profile, spray velocity, rapid response and rapid start-up features make the present invention uniquely suitable to a wide range of applications including, but not limited to, the following:

(i) a thermal spraying application, particularly using high-velocity oxy-fuel (HVOF) or plasma spraying systems;

(ii) welding; fusing; hardening; nitriding; carburizing; laser glazing; induction heat treating; brazing; extrusion; casting; finish-rolling; forging; embossing; engraving; patterning; printing, scribing or slitting of metal strip, tape, or tube; cryogenic cutting and grinding of metal and non-metal components; and (iii) processing, surfacing, or assembly in the metals, ceramics, aerospace, medical, electronics, and optical industries.

In addition to the pressure of the throttling gas, the temperature of the throttling gas also plays a role in the present invention. In particular, the boil-off that is generated when the throttling gas contacts the cryogenic liquid contributes to the throttling effect. Typically, the temperature of the throttling gas introduced into the contact zone is ambient (as this ensures a suitable boil-off without the need to either heat or cool the throttling gas) and the gas pressure functions as the preferred "control lever" in the present invention. However, in terms of regulating the boil-off contribution to the throttling effect, the gas temperature could also function as the control lever, either by itself (i.e. such that the gas pressure is held constant), or in combination with adjustments in gas pressure. Also, noting that any amount of heat added to a saturated cryogenic liquid will cause at least some boil-off, the temperature of the throttling gas is preferably greater than the temperature of the cryogenic liquid. Finally, regarding the temperature, it is possible to reduce the pressure required for any particular throttling rate by using a temperature higher than ambient, but if the temperature is too high, the ability to fine tune the liquid component as a function of the gas pressure can be compromised.

In order to ensure the throttling gas does not condense when contacted with the cryogenic liquid, the throttling gas boiling point should be less than or equal to the cryogenic liquid's boiling point. Consequently, if the cryogenic liquid is saturated nitrogen, the throttling gas can comprise nitrogen but not argon, while if the cryogenic liquid is saturated argon, the throttling gas can comprise either nitrogen or argon. Typically, cost and availability factors favor liquid nitrogen as the cryogenic liquid and gaseous nitrogen as the throttling gas. Also, noting that the oxygen component of air could inadvertently condense in the contact zone and create a flammability concern, air is typically undesired as the throttling gas. Finally, regarding the choice of fluids in the present invention, note liquid carbon dioxide is typically unacceptable as the cryogenic liquid because it freezes on expansion and may form ice plugs inside nozzle.

The exact relationship between the throttling gas pressure and (i) the ratio of the discharged fluid's liquid-to-gaseous mass flow rates (hereafter, "$D_{L/G}$"), and (ii) the total mass flow rate of the discharged fluid (hereafter, "$D_F$") will depend on a number of factors including, but no limited to, the temperature of the throttling gas as noted above, the choice of the cryogenic liquid and gas, the size of the nozzle and contact zone, and the configuration between the nozzle and contact zone. In addition, since the throttling gas can be expected to incur at least a moderate pressure drop in the supply line connecting the pressurized supply of the throttling gas to the contact zone, this pressure drop must also be taken into account. Accordingly, the exact relationships should be experimentally determined for any particular system. Described below, however, are the observed relationships based on Applicant's experimentation with saturated liquid nitrogen as the cryogenic liquid and ambient temperature nitrogen as the throttling gas over a range of liquid and gas pressures between 10 and 350 psig, and a range of nozzle sizes and contact zone configurations. Note the relationship between the throttling gas pressure and the introduction rates of the liquid and gaseous nitrogen into the contact zone (hereafter, "$F_L$", and "$F_G$" respectively) are also included as these relationships also provide insights into the present invention as further discussed below.

The relationships for one embodiment of the invention referenced above are as follows. With respect to increases in the throttling gas pressure between a gas pressure equal to the cryogenic liquid pressure (hereafter, the "un-throttled condition"), and a gas pressure equal to 1.05-1.3 times the cryogenic liquid pressure gage (hereafter, the "fully throttled condition"), such gas pressure increases resulted in:

(i) proportional decreases in $D_{L/G}$ between 1.0 and nearly zero;

(ii) proportional decreases in $D_F$ between the maximum $D_F$ that occurs in the un-throttled condition, and the minimum $D_F$ that occurs in the throttled condition which is a fraction or a small fraction of the maximum $D_F$;

(iii) proportional decreases in $F_L$ between the maximum $F_L$ that occurs in the un-throttled condition, and the minimum $F_L$ that occurs in the throttled condition which is a small fraction, e.g. 10-15%, of the maximum $F_L$ for some embodiments; and (iv) proportional increases in $F_G$ between the minimum $F_G$ that occurs in the un-throttled condition which is equal to about 0-11% of the maximum $F_L$, and the maximum $F_G$ that occurs in the throttled condition which is equal to 10-35% of the maximum $F_L$ for many embodiments.

In alternative embodiments, the ratio between the gas pressure and the liquid pressure at their respective inlets into the contact zone of the nozzle may be any value greater than 1 or may vary between greater than 1 to 100.

As suggested above, the above relationships provide a number of insights into the present invention as follows:

(i) The gas pressure to achieve the fully throttled condition is advantageously modest, namely only 1.05-1.30 times the pressure of the cryogenic liquid on a gage pressure basis. The higher gas supply pressures are even more effective but not necessary if the nozzle is designed within the other specifications described here, e.g. the preferred impingement angle of the gas and liquid streams inside the nozzle conduits. Also, pursuant to (iv) above, and noting the throttling gas pressure and throttling gas introduction rate will always directly correspond for a specific design and geometry, this translates into a modest throttling gas introduction rate required to achieve the fully throttled condition, namely only about 10-35% of the cryogenic liquid introduction rate that occurs in the un-throttled condition.

(ii) Pursuant to (iii) above, the cryogenic liquid feed rate is not zero in the fully throttled condition as might be expected, but is instead about 10-15% of the flow rate of the cryogenic liquid introduction rate that occurs in the un-throttled condition. This means that the boil-off is contributing to the throttling effect even when the discharged fluid contains no liquid. Also, this has the advantage of facilitating the present invention's rapid response feature even from the fully throttled condition since the cryogenic liquid introduction rate does not have to be turned off and re-started.

(iii) Pursuant to (iv) above, note the throttling gas feed rate can be as high as 11% before a departure (or at least a significant departure) from the un-throttled condition occurs. This is related to the initial build-up of the throttling gas in the supply line and contact zone.

Applicant's experimentation provided additional characteristics specific to the two broad categories of the configurations between the contact zone and nozzle in the present invention. In the first category, hereafter the "shot gun" configuration, the contact zone comprises a conduit which discharges the fluid head-on through a single opening nozzle. In the second category, hereafter the "spray tube" configuration, the contact zone comprises a conduit that discharges the fluid in a radial direction from the conduit through a nozzle along the longitudinal length of the wall of the conduit that consists of either a row of openings or a slit. Several basic variations of the spray tube configuration are disclosed herein. In one variation, (hereafter, the "single tube" variation), the cryogenic liquid and throttling gas are introduced into one, or typically both, ends of the contact zone-comprising conduit. In another variation (hereafter, the "tube-in-tube" variation), the throttling gas is introduced into one or both ends of the annular space defined by concentric tubes, while cryogenic liquid is introduced into the annular space through a series of openings in the inner tube that are in radial flow communication with the contact zone-comprising annular space. The characteristics specific to each of these configurations are detailed in the following discussion of the figures.

Figure 1C:
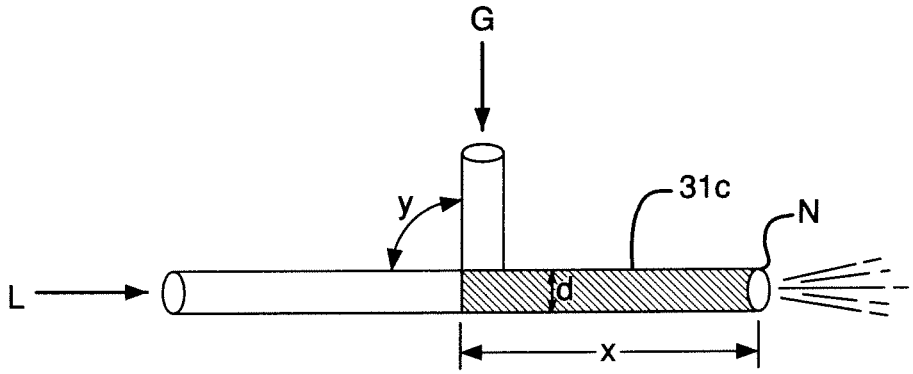
FIG. 1C shows one embodiment of the present invention.

The embodiment of the present invention shown in FIG. 1C is an example of the shot-gun configuration between the contact zone and the nozzle. In FIG. 1C, the contact zone comprises a conduit 31*c* (identified by the cross-hatching in FIG. 1C) having a downstream end in head-on flow communication with nozzle N, and an upstream end in flow communication with a supply of both the cryogenic liquid supply L via first supply line, and the throttling gas G via second supply line. The cryogenic liquid and the throttling gas are introduced into the contact zone through their respective supply lines and contacted to form a resulting fluid. The resulting fluid is discharged through the nozzle while continuing to introduce the cryogenic liquid and throttling gas into the contact zone.

FIG. 1C also embodies Applicant's observation that the ability to "fine-tune" the discharged fluid's liquid-to-gaseous ratio in the shot gun configuration is enhanced when:

(i) from a process standpoint, the cryogenic liquid and throttling gas impinge each other upon their introduction into the mixing at an angle y that may be any value, for example, between 0 to 360° or from 0 to 270°, or 0° to 180°, but for some embodiments is from 45° to 135° or from 45° to 90° (and preferably 90° as shown in FIG. 1C). (The angle y as shown is the angle formed between the liquid conduit and the gas conduit; that is, the angle formed between the direction of the flow of the gas and the liquid as they are introduced into each other in the contact zone. The direction of the flow of the liquid and gas in the nozzle is indicated by the arrows adjacent to the L and G.); and (iii) from an apparatus standpoint, the length x of the contact zone conduit 31*c* (identified by the cross-hatching in FIG. 1C) may be any value, but may be between 1.0 and 40 times the diameter d of the conduit at it narrowest point.

Note that the Figures show embodiments that have either the liquid or gas lines head on with the discharge end of the nozzle. The nozzle of the invention is not limited to the embodiments shown, and this invention provides that the liquid and gas conduits within the nozzle can be configured so that neither is in head on flow with the discharge end of the nozzle. For examples, the cryogenic liquid conduit and the gas conduit and the contact zone could be arranged in the nozzle 120° from each other, or the cryogenic liquid conduit and the gas conduit could be 90° apart and the contact zone could be located 135° from both of those conduits. In alternate embodiments, two or more gas conduits could be provided into each cryogenic liquid conduit in a nozzle. It is preferred when two or more gas conduits are used within the nozzle that they are spaced 45° to 90° from the cryogenic liquid conduit, although any angles may be used as described earlier.

Figure 2A:
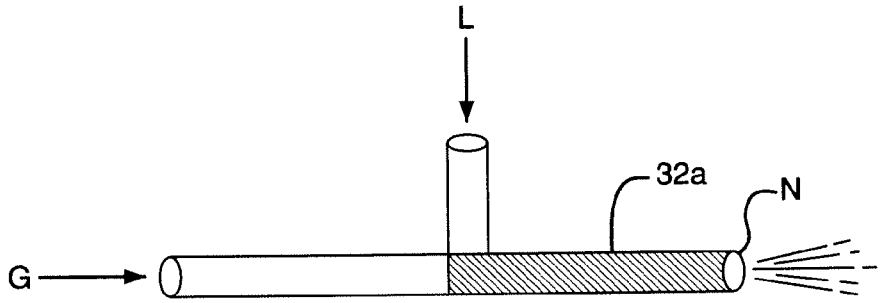
FIG. 2A to 2D show various other embodiments of the present invention having different contact zone and/or nozzle configurations.

FIG. 2A is identical to FIG. 1C except the orientation of the supply streams with respect to the contact zone conduit 32*a* (identified by the cross-hatching in FIG. 2A) is reversed. In this respect, FIG. 2A embodies Applicant's observation that the fine tuning in the shot gun configuration is further enhanced when the impingement angle is oriented such that:

(i) from a process standpoint, the throttling gas is in head-on flow communication with the conduit's upstream end; and (ii) from an apparatus standpoint, the conduit of the pressurized gas supply G is in head-on flow communication with the contact zone, while the conduit of the cryogenic liquid supply L is in 45°-135° flow communication, or 90°-135° flow communication with the contact zone (and preferably 90° as shown in FIG. 2A).

Figure 2B:
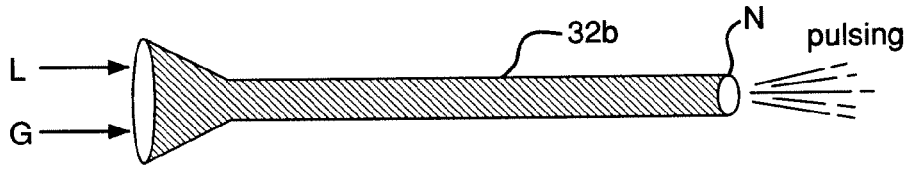

FIG. 2B is identical to FIG. 2A except the cryogenic liquid and throttling gas are introduced into the contact zone conduit 32*b* (identified by the cross-hatching in FIG. 2B) in parallel and head-on. Applicant's observed that impingement angles less than 45° between the gas and the liquid (and especially impingement angles equal to zero such as in FIG. 2B) tended to result in a narrow, on/off-like tuning range. When these nozzles were not in either the substantially un-throttled or substantially fully throttled condition, they tended to have a pulsating discharge from the nozzle. Therefore, nozzles configured with smaller impingement angles (that is less than 45° between the liquid and gas flow directions on a macro scale into the contact zone) would be useful mostly for applications that change between the substantially un-throttled and substantially fully throttled conditions.

Figure 2C:
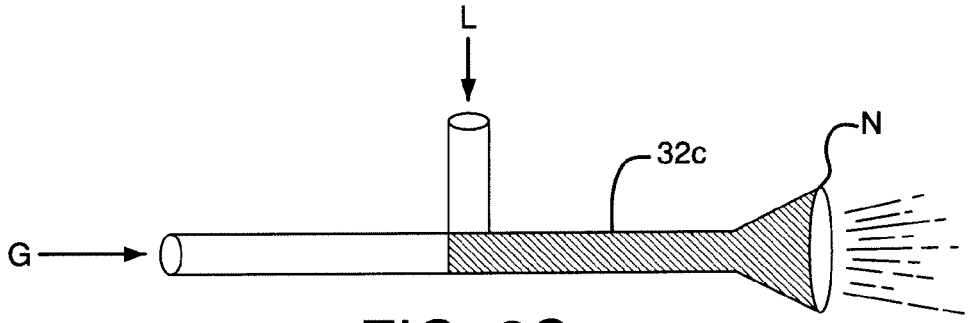

FIG. 2C is identical to FIG. 2A except the contact zone conduit 32*c* (identified by the cross-hatching in FIG. 2C) and the nozzle N are modified such that the conduit's downstream end diverges into a larger nozzle size in order to provide a more dispersed spray.

Figure 2D:
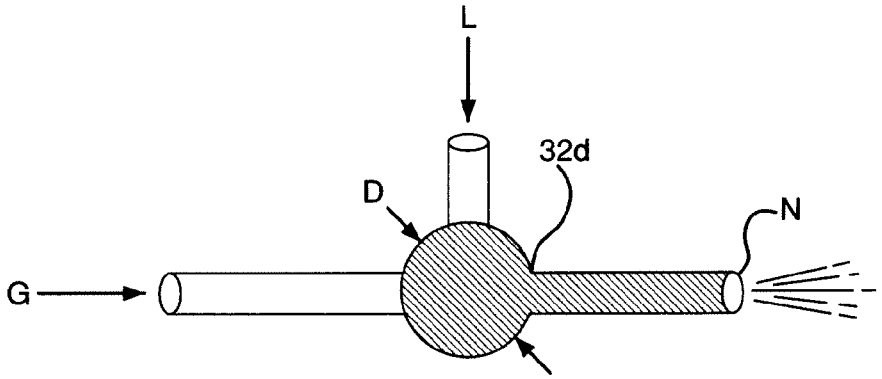

FIG. 2D is identical to FIG. 2A except the contact zone conduit 32*d* (identified by the cross-hatching in FIG. 2D) contains a spherical chamber at its upstream end. In this respect, FIG. 2D embodies Applicant's observation that the fine tuning ability is also affected by the diameter of such a chamber. In particular, the diameter D of the chamber is preferably between 1.0 and 6.0 times the diameter of the conduit at it narrowest point.

Figure 3:
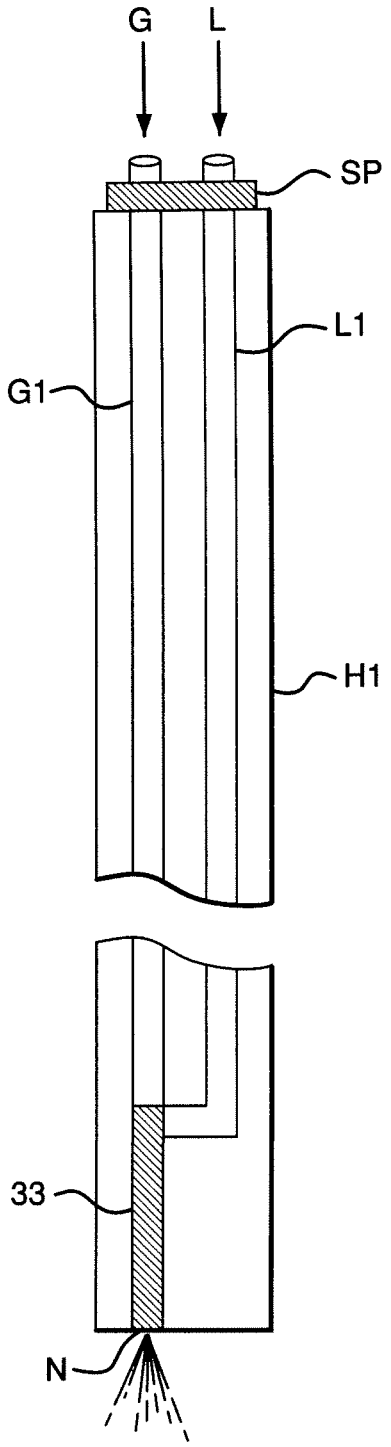
FIG. 3 shows an additional embodiment of the present invention.

FIG. 3 is identical to FIG. 2A except:

(i) the shot gun configuration between contact zone 33 (further identified by the cross-hatching) and nozzle N is vertically oriented;

(ii) the contact zone, the gas supply line G1, and the cryogenic liquid supply line L1 all comprise ¼ inch diameter carbon-fluorine polymer tubing (which retains a degree of flexibility even when cooled to cryogenic temperatures) and are shielded from mechanical damage by a ¾ inch diameter flexible stainless steel hose H1; and (iii) a soft foamy plug SP is used at the entry point to the stainless steel hose to prevent accumulation of condensed water inside the hose. Alternate materials known to a person of skill in the art can be used.

The fluid passages shown in FIGS. 1C, 2A-2D and 3 are the constrictions within the nozzle and those figures do not show the supply lines to the nozzle.

Figure 4:
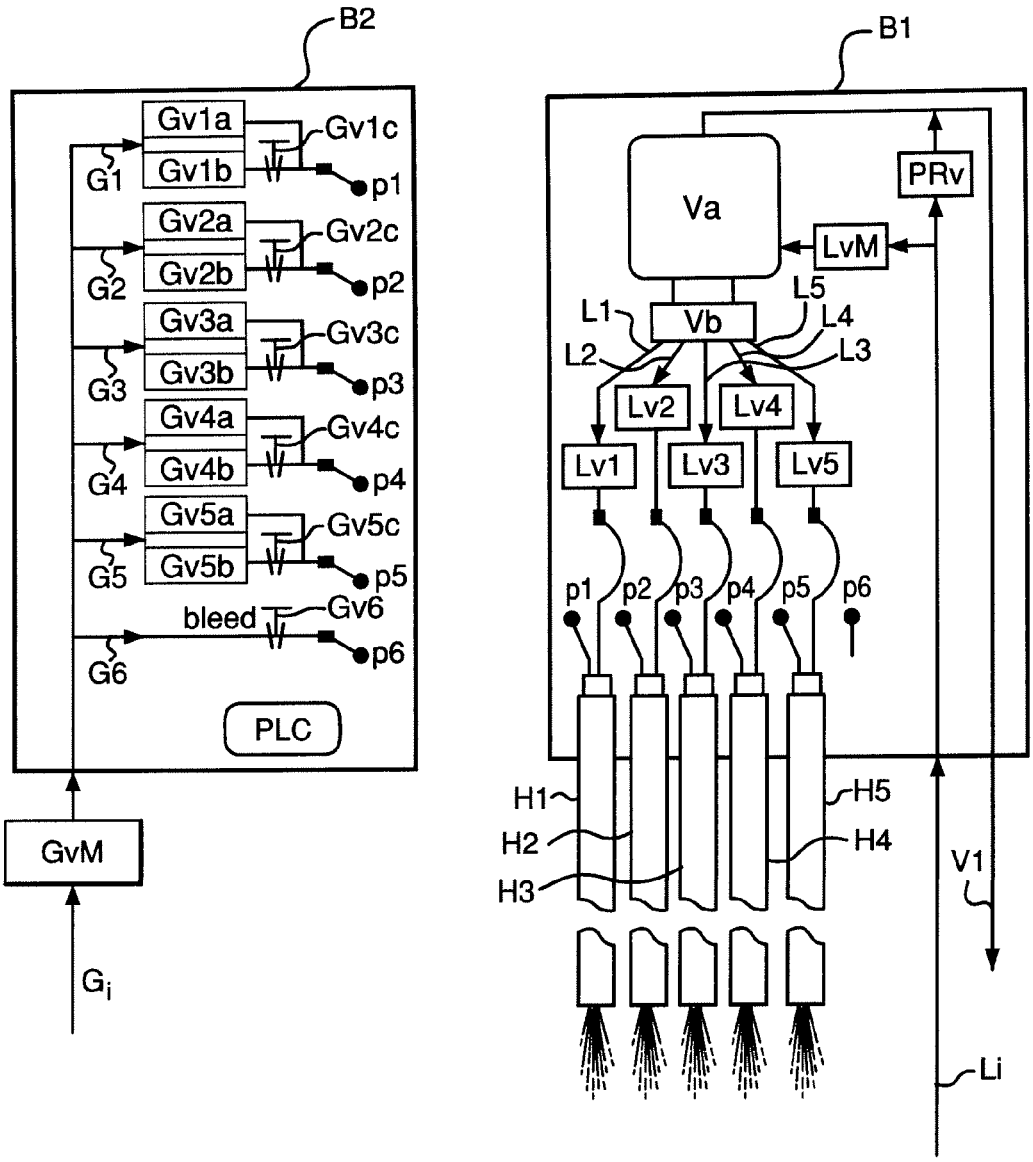
FIG. 4 shows another embodiment of the present invention having multiple spray nozzles.

FIG. 4 shows an industrial cryogenic cooling and cleaning system comprising five respective cooling lines H1 through H5 which are identical to the apparatus in FIG. 3. The system comprises a cold box B1 housing the cryogenic components, and an ambient temperature box B2 housing the throttling gas components. The inlet cryogenic liquid L1 enters the cold box via main liquid valve LvM and a conventional vapor venting valve Va which gravitationally separates and vents the vapor from the incoming stream. Pressure relief valve PRv is added at the inlet side for safety. The bottom-pouring outlet Vb of the vapor vent is connected to the five cooling lines H1 through H5 via respective intermediate supply lines L1 through L5 and respective solenoid valves Lv1 through Lv5. Typically, the cooling lines H1 through H5 are each from ten to twenty five feet long so that the operators can easily move the lines to the point of use as may be required. Since the polymer tubing in the cooling lines will shrink much more than the surrounding stainless steel hose, the tubing between the cooling lines and the solenoid valves is extended by an additional 3 inches in order to prevent tensile stresses that would otherwise build on the tubing after cool-down. Other solutions could also be used to prevent excessive tensile stresses on the tubing such as a spring-loaded, contracting, bellows-type, stainless steel hose. The inlet gas Gi enters the ambient temperature box B2 via main valve GvM. Here, the gas stream is divided into respective branched streams G1 through G6. Stream G6 leads to a manually adjustable bleed valve Gv6 which discharges a minute quantity of gas into the cold box via port p6 in order to inert that box and prevent internal moisture condensation. Each of respective streams G1 through G5 is directed to a respective pair of solenoid valves Gv1*a*/Gv1*b* through Gv5*a*/Gv5*b*.

The function of the respective first solenoid valve Gv1*a* through Gv5*a* in each pair is to open or close the flow of gas needed in the fully throttled condition. The function of the respective second valve Gv1*b* through Gv5*b* in each pair is to open or close the flow of gas to the respective manually adjusted valves Gv1*c* through Gv5*c*. The opening of the manually adjusted valve is adjusted by the operators beforehand in order to select the throttling gas flow rate that corresponds to the desired ratio of the discharged fluid's liquid-to-gaseous ratio. This desired ratio reflects the normal cooling flow rate which can be rapidly reduced to zero, and then quickly re-started by opening or closing the respective Gv1*a* through Gv5*a* valve. If all five branches are not needed in a given cooling and blasting operation, both the corresponding gas and liquid valves stay closed. An electric, programmable controller PLC is housed in the ambient temperature box to control the desired valve opening and closing sequence and is connected to the valves, a control panel and, optionally, to remote temperature and/or cleaning sensors. Downstream of the gas controlling valves, the gas lines fluidly communicate with the respective cooling lines H1 through H5 via respective ports p1 through p5.

The embodiment shown in FIG. 4 was evaluated using stainless steel nozzles having a 0.1 inch diameter and a 1.0 inch long contact zone. Saturated liquid nitrogen Li was supplied to cold box B1 at 80 psig via main liquid valve LvM, while room temperature nitrogen Gi was supplied to the ambient temperature box B2 at 100 psig via main gas valve GvM. Both these valves were subsequently opened to take the system into a standby mode and pre-cool the cryogenic components housed in cold box B1 prior to operation. In the next step, respective valves Lv1 through Lv5 were opened to measure the maximum flow rate of the liquid nitrogen through the respective cooling lines H1 through H5. A uniform liquid spray was established after less than 30 seconds, even though the line start-up temperature was ambient. The fluid discharge rate was 2.75 lbs/minute and comprised a 4-inch long, fine droplet spray, followed with a 6-inch long, fast and white tail of cryogenic temperature vapor. Next, respective valves Gv1*a* through Gv5*a* were opened to the fully throttled condition to find the gas flow rate required to convert the spray discharge into ambient temperature nitrogen. For this embodiment, the full-throttling nitrogen gas mass flow rate measured was 1.0 lb/minute per nozzle. Additionally for this embodiment, the liquid nitrogen inlet rate in the fully throttled nozzle condition was 0.3 lbs/minute per nozzle. Next, respective valves Gv1*a* through Gv5*a* were closed which resulted in the restoration of a visible liquid nitrogen spray within a couple of seconds. Next, the respective valves Gv1*b* through Gv5*b* were opened and the respective valves Gv1*c* through Gv5*c* were adjusted to obtain larger or smaller gas flow rates into the respective cooling lines H1 through H5. The manipulation of the gas flow rate using respective valves Gv1*c* through Gv5*c* resulted in the expected partial throttling of the liquid component of the spray discharge with the consequence of warming-up the discharge and a rapid transition between the cooling and gas-blasting functionalities.

After a substrate part has been processed by the nozzle's cooling functionality, the gas-blasting functionality can be used to increase the part's temperature to room temperature to avoid condensation of ambient moisture thereon. Although this evaluation uses the cooling lines identically controlled by the controller PLC based on the thermal input from external temperature sensors, the system may comprise any number of differently sized cooling lines from one to as many as practical, e.g. twenty. Also, each cooling line may be controlled by the PLC independently from the other cooling lines and use its own thermal input.

Figure 5:
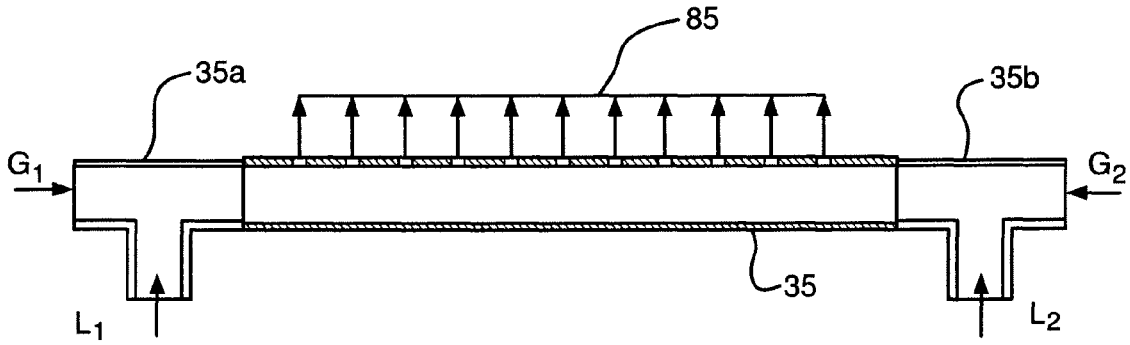
FIG. 5 shows a single-conduit spray tube embodiment of the present invention.

The embodiment shown in FIG. 5 is an example of the single spray tube configuration in the present invention wherein:

(i) the contact zone comprises a conduit 35 having a first feed end 35*a* and an opposing feed end 35*b;*

(ii) the nozzle comprises either a row of openings (as shown in FIG. 5) or a slit along the longitudinal length of the wall of the conduit;

(iii) as supplied by a supply line in flow communication with a cryogenic liquid supply, the cryogenic liquid $L_1$ is introduced into the conduit through at least one of the conduit's feed ends (and typically both feed ends as shown by $L_2$ in FIG. 5);

(iv) as supplied by a supply line in flow communication with a pressurized gas supply, the throttling gas $G_1$ is also introduced into the conduit through at least one of the conduit's feed ends (and typically both ends as shown by $G_2$ in FIG. 5); and (v) the fluid is discharged through the nozzle in a radial direction from the conduit as represented by spray profile 85 in FIG. 5.

FIG. 5 embodies Applicants' observation that the ability to fine-tune the discharged fluid's liquid-to-gaseous ratio, and therefore its liquid flow rate, in the single tube configuration is enhanced when:

(i) from a process standpoint, the cryogenic liquid and throttling gas impinge each other at 45°-135° or 45°-90° (and preferably 90° as shown in FIG. 5) upon their introduction into the contact zone, and the throttling gas is in head-on flow communication with the feed end(s) of the conduit;

(ii) from an apparatus standpoint, the supply line connecting the contact zone to the pressurized gas supply is in head-on flow communication with the feed end(s) of the contact zone, while the supply line connecting the upstream end of the contact zone to the cryogenic liquid supply is in 45°-135° or 90°-135° flow communication with the feed end(s) of the contact zone (and preferably 90° as shown in FIG. 5), (The angle between the flow of the gas and the liquid into the contact zone is shown as 90° and may be between 45° and 90° or other values as described previously.) and (iii) also from an apparatus standpoint, the ratio of the conduit's length to its diameter may be between 4 and 20 (noting at ratios larger than 20, the conduit may become too long for a sufficient degree of impingement contact to occur in the middle area of the conduit).

Figure 6A:
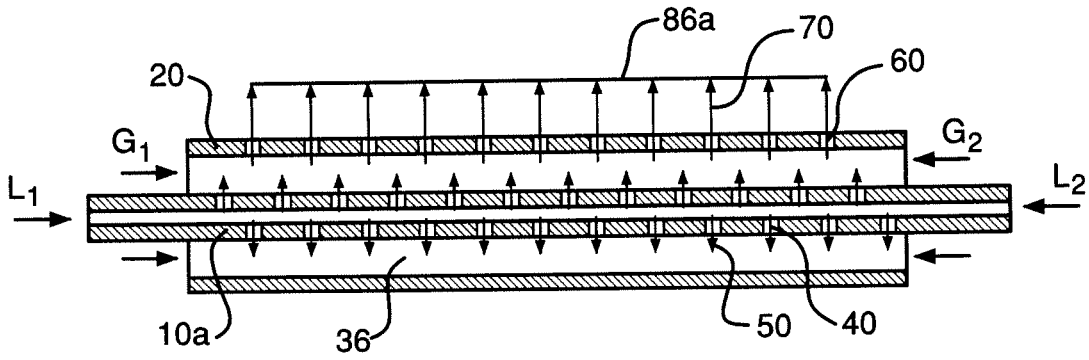
FIG. 6A to 6I show several double-conduit spray tube embodiments of the present invention.

The embodiment of the present invention shown in FIGS. 6A is an example of the tube-in-tube variation of the spray tube configuration wherein:

(i) the contact zone comprises an annular space 36 defined by an outer conduit 20 concentrically surrounding an inner conduit 10*a;*

(ii) the annular space has a first feed end and a second (an opposing) feed end;

(iii) the inner conduit has a first inlet end and a second (an opposing) inlet end which are adjacent to, respectively, the first feed end and the opposing feed end of the annular space, (iv) the inner conduit contains a plurality of openings 40 in its wall for uniformly dispersing the cryogenic liquid into the annular space as represented by streams 50 in FIG. 6A (as shown the flow of the liquid into the gas is 90° to the direction of the flow of the gas on a macro scale as indicated by the arrows labeling streams 50 and the arrows labeling the flow direction for $G_1$ and $G_2$);

(v) the nozzle comprises a row of openings 60 as shown in FIG. 6A (or optionally a slit) along the longitudinal length of the wall of the outer conduit and is selected from the group consisting of a row of openings and a slit; and (vi) as supplied by a supply line in flow communication with a pressurized gas supply, the throttling gas $G_1$ is introduced into the annular space through at least one of the feed ends of the annular space (and typically both ends as shown by $G_2$ in FIG. 6A);

(vii) as supplied by a supply line in flow communication with a cryogenic liquid supply, the cryogenic liquid $L_1$ is introduced into the inner conduit through at least one of the inlet ends of the inner conduit (and sometimes both ends as shown by $L_2$ in FIG. 6A);

(viii) the cryogenic liquid is dispersed into the annular space through the plurality of openings contained in the wall of the inner conduit in a radial direction from the inner conduit; and (ix) the fluid 70 is discharged through the nozzle in a radial direction from the outer conduit as represented by spray profile 86*a* in FIG. 6A.

The tube-in-tube variation of the spray tube embodiment embodies Applicant's observation that the fine tuning ability of the spray tube embodiment is increased by effecting the impingement contact between the liquid and the gas along the length of the annular space (or at least along the length in which the gas is able to maintain it's velocity). This also enables an increase in the contact zone's length to diameter ratio from the 4-20 range of the single tube variation to a range of 4-80. For different embodiments, the range of the minimum diameter and length of the contact zone is between 1 and 80 times the minimum diameter.

The inner and outer conduits in the tube-in tube variation of the spray tube configuration can be made of stainless steel, aluminum, copper, or cryogenically compatible polymers such fiber-reinforced epoxy composites, ultra-high molecular weight polyethylene, and the like. The typical diameter of the inner conduit may vary between 1 mm and 25 mm while the typical diameter of the outer conduit may vary between 3 mm and 75 mm. The typical ratio between the outer conduit diameter to the inner conduit diameter may vary between 2 and 8. As noted above, the typical length-to-diameter ratio with respect to the outer conduit may vary between 4 and 80. The wall thickness of the inner conduit depends on the material of construction selected and may be as small as practical during device fabrication but sufficient to hold the pressure of the fluid filling this conduit. Typical wall thickness preferably ranges may range between 1%-10% of the inner conduit diameter. There is no need for any special orientation of the plurality of openings in the inner conduit as long as their distribution inside the annular space is relatively uniform.

The nozzle openings in the outer conduit are preferably aligned in one specific direction in order to be able to discharge fluid in that direction. The wall thickness of the outer conduit is preferably selected to provide a sufficiently long expansion channel for the fluid exiting the nozzle openings. Such a sufficiently long channel depends on various operating parameters, but it is typically selected by comparing its length, i.e. the outer wall thickness, to its diameter or bore. The typical length-to-diameter ratio of the nozzle openings varies between 3 and 25. In the embodiments in FIGS. 6*a* to 6I, the typical bore of the nozzle openings is between 0.4 and 2.0 mm. Consequently, once the fabrication and pressure requirements are satisfied, the outer conduit wall should be further selected to be at least 1.4 mm and often exceeding 40 mm. Finally, the ratio of the total cross-sectional area of the nozzle openings in the outer conduit wall to the total cross-sectional area of the openings in the inner conduit wall is typically 1.0, although an expanded ratio range between 0.5 and 2.0 is workable.

The embodiment shown in FIG. 6A was assembled using the following components and specifications.

(i) The inner conduit made of stainless steel and having the inner diameter of 0.335 inches, an outer diameter of 0.375 inches, and length of 35.5 inches, and containing 94 holes, each having an inner diameter of 0.03 inches.

(ii) The outer tube was made of a fiber-reinforced, cryo-compatible epoxy having an inner diameter equal to 0.745 inches, an outer diameter equal to 1.1 inches and a length equal to 34.5 inches, and containing 83 nozzle-openings along a straight line, each having an inner diameter equal to 0.035 inches and spaced from another using a 0.35 inch step.

(iii) The ratio between the outer tube outer diameter and the inner tube outer diameter was 2.9. The length-to-diameter ratio of the outer tube was 31.4. The wall thickness of the inner tube was 5% of its outer diameter. The outer tube wall thickness was 4.5 mm, and the length-to-diameter ratio of each nozzle-opening was 5. The ratio of the total cross-sectional surface area of the nozzle openings in the outer conduit to the total cross-sectional surface area of the openings in the inner conduit was 1.2.

As will be described in greater detail herein, the tube-in-tube variation of the spray tube provides that ability to adjust the "spray profile" of the spray tube. The spray profile is defined by the collective liquid component discharges from each of the nozzle openings. In FIGS. 6A through 6I, the relative cryogenic liquid flow rate at each nozzle opening is represented by lines of varying length. A longer line signifies a greater flow rate and vice versa. In the tube-in-tube spray tube variation, the spray profile can be manipulated as a function of:

(a) the throttling gas pressure;

(b) which annular space end(s) the throttling gas is introduced; and (c) where the throttling gas is introduced into both ends of the annular space, a variance in the pressure of the throttling gas introduced into each end.

The relationship between the spray profile and the above variables is explained in more detail in connection with FIGS. 6A to 6I.

In FIG. 6A, the pressure of the throttling gas introduced into both ends of the annular space is equal to the pressure of the cryogenic liquid introduced into both ends of the inner conduit (i.e. the un-throttled condition) and the resulting spray profile 86*a* is "flat" as shown in FIG. 6A.

Figure 6B:
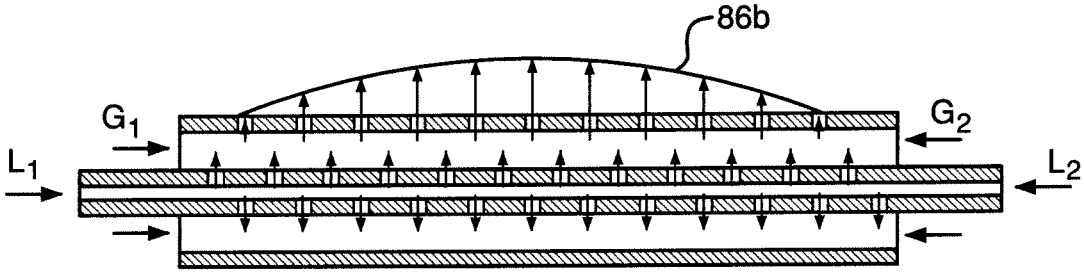

FIG. 6B is identical to FIG. 6A except the pressure of the throttling gas is slightly greater than the pressure of the cryogenic liquid. As a result, the spray profile 86*b* is "squeezed" into a parabolic shape as shown in FIG. 6B. This suggests that most of the boil-off is being generated at the ends of the annular space and "pushing" the remaining liquid toward the center of the tubes. As a result, the discharge from the nozzle openings located near the ends of the annular space is compose mostly of gas, and therefore, has a relatively low liquid flow rate. The discharge through the nozzle openings near the center of the spray tube contains a larger liquid fraction, and therefore, a higher liquid flow rate.

Figure 6C:
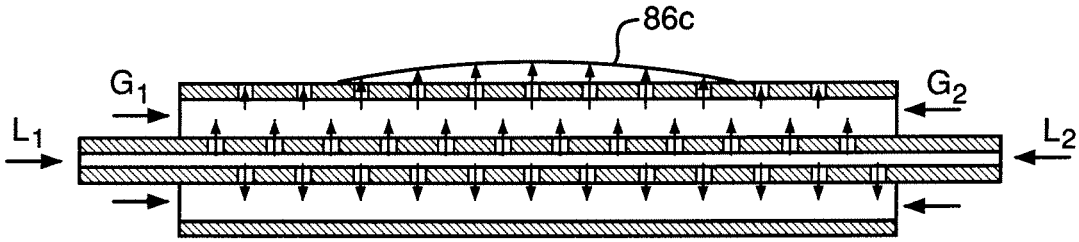

FIG. 6C is identical to FIG. 6B except the gas pressure is further increased, thereby further squeezing the spray profile 86*c*. As the gas pressure is further increased to the fully throttling condition, the spray discharge is completely gaseous and at room temperature.

Figure 6D:
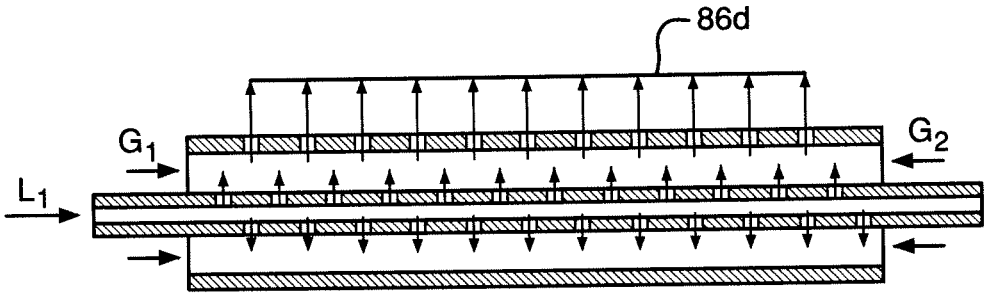

FIG. 6D is identical to FIG. 6A except the cryogenic liquid is only introduced into one end of the inner conduit which, as shown by spray profile 86*d*, is sufficient to assure the same symmetrical and uniform spray profile as in FIG. 6A.

Figure 6E:
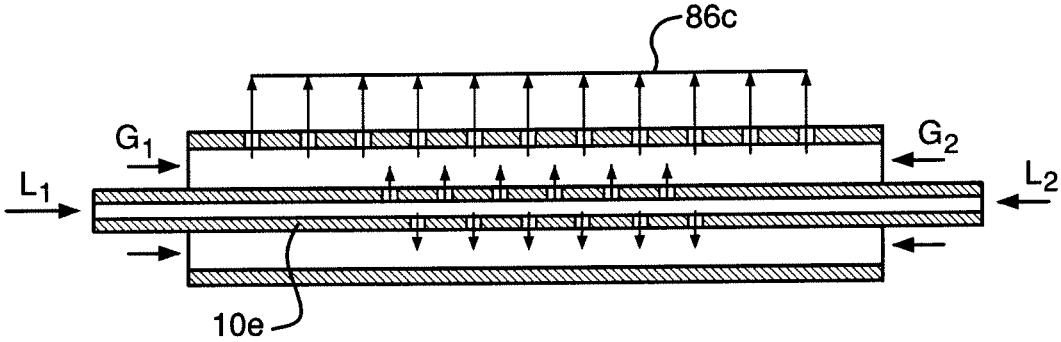

FIG. 6E is identical to FIG. 6A except inner conduit 10*e* is modified such that the opening are fewer and all clustered around the center of the tube. This resulted in less controllability of the liquid component of the discharge as compared to FIG. 6A although a similar spray profile 86*e* was achieved.

Figure 6F:
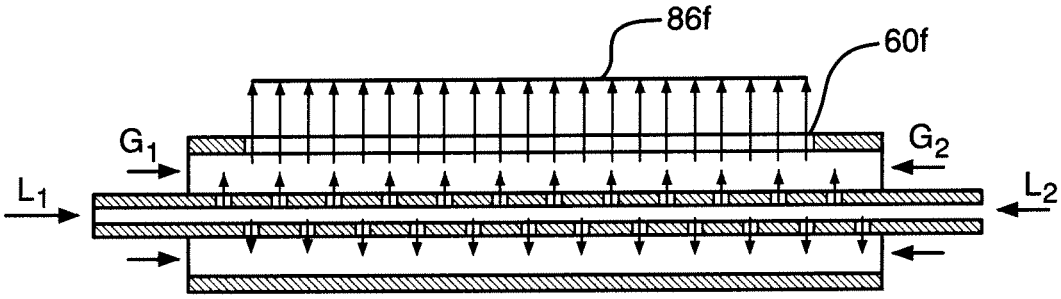

FIG. 6F is identical to FIG. 6A except the nozzle consists of a single slit 60*f* in the outer conduit which, as shown by spray profile 86*f*, did not affect the spray profile.

Figure 6G:
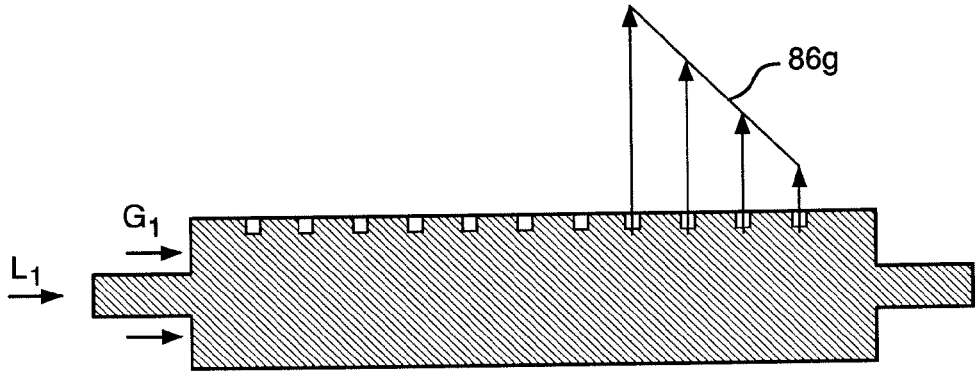
Figure 6H:
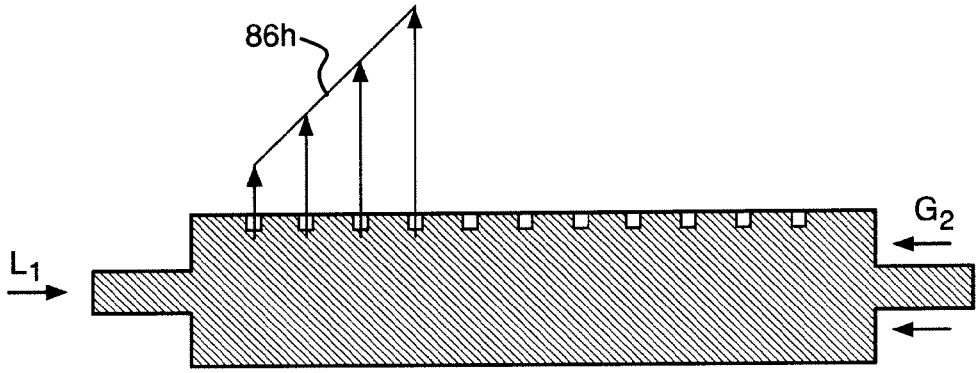
Figure 6I:
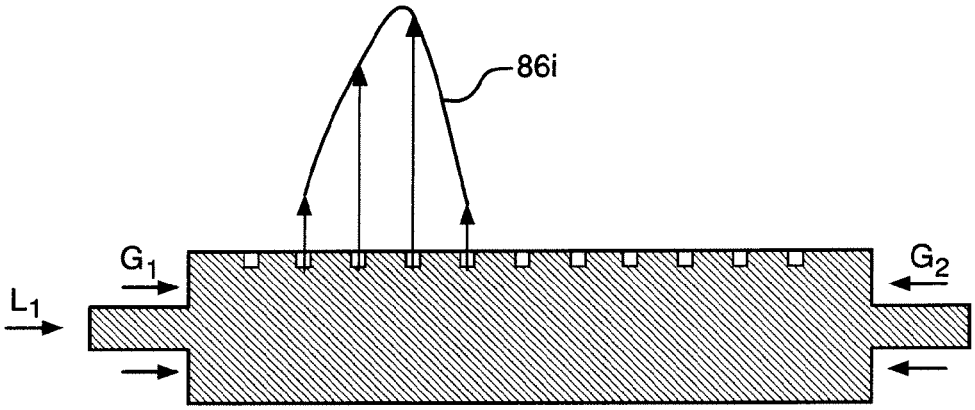

FIGS. 6G, 6H and 6I show the effect on the spray profile when the pressure of the throttling gas introduced into each end is varied. As shown In FIGS. 6G and 6H, the effect of introducing the throttling gas at only one end of the annular space resulted in shifting the respective spray discharge 86*g* and 86*h* to the opposite end. In FIG. 6I, the throttling gas pressure for G2 introduced on the right side is higher than the throttling gas pressure for G1 introduced on the right side and the resulting spray discharge 86*i* is pushed to the lower pressure side.

FIGS. 6G, 6H and 6I embody the feature of the spray tube embodiment whereby a desired spray profile can be achieved by providing the gas at the gas inlets G1 and G2 a the respective pressures that will produce the desired spray profile. Similarly, other desired spray profiles can be achieved by simply adjusting the gas pressure at the gas inlets G1 and G2. It should be noted, however, that the pressures at G1 and G2 necessary to achieve a specific spray profile may change due to changes in the operating environment of the spray tube, such as temperature.

Figure 7:
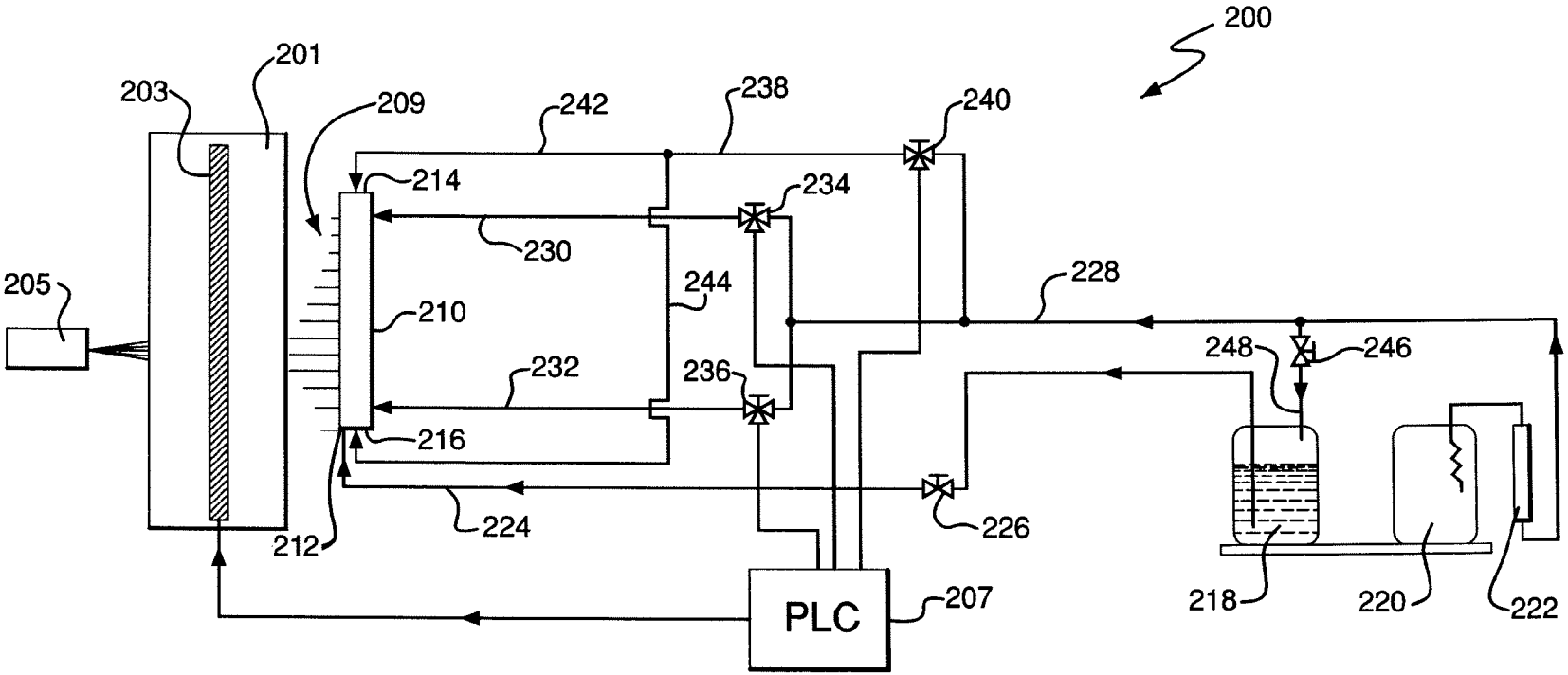
FIG. 7 shows a spray tube system that is adapted to track a moving heat source.

FIG. 7 shows one embodiment of a spray system 200 which could incorporate any of the spray tube embodiments disclosed herein. The system comprises a spray bar 210, a pressurized tank 218 containing a cryogenic liquid (LIN in this embodiment), a pressurized tank 220 containing the throttling gas (gaseous nitrogen at ambient temperature in this embodiment), a vaporizer 222, a programmable logic controller ("PLC") 207, a temperature sensor 203. The spray bar is a spray tube of any configuration disclosed herein which is partially enclosed in a solid or semi-porous casing or box structure. The casing or box structure is opened only in the direction that the cryogenic fluid is jetted from the nozzles and is purged from the inside of the casing or box structure with a dry, room temperature gas in order to prevent nozzle icing. The purge gas may be the same as the throttling gas and sourced from the same tank, but the purge gas flowrate is typically constant throughout the entire cooling operation and unrelated to the liquid or gaseous flows through the spraying tube.

In this embodiment, the spray bar 210 includes one cryogenic liquid inlet 212 and two throttling gas inlets 214, 216. A cryogenic liquid supply line 224 supplies LIN from the tank 218 to the cryogenic liquid inlet 212. A solenoid valve 226 turns the supply of LIN on and off.

A gas supply line 228 supplies throttling gas from the tank 220 to the spray bar 210. The gas supply line 228 splits into two branches 230, 232, each of which is connected to one of the throttling gas inlets 214, 216. An adjustable valve 234, 236 is located on each of the branches 230, 232 to enable adjustment of the downstream gas pressure and flowrate in each of the branches 230, 232. Optionally, a solenoid valve (not shown) could be provided in series with each of the adjustable valves 234, 236 to enable gas flow to be turned on and off without having to readjust the adjustable valves 234, 236. When operated, the gas throttling streams 230, 232 control (increase, decrease or maintain) the liquid flow rate, blasting function, and liquid spray pattern as discussed above.

A gas purge line 238 is tapped into the supply line 228 upstream from the branches 230, 232. The gas purge line 238 includes a solenoid valve 240 and two branches 242, 244 which are located downstream from the solenoid valve 240 and each connect to one of the gas inlets 214, 216. When operated, the gas purge line 238, and its branches 242 and 244 supply to the spray bar 210 de-icing gas which prevents frosting of the cryogenic fluid spraying nozzles.

In FIG. 7, the spray bar 210 is being used to cool a cylindrical substrate 201 (e.g., steel) that is being heated by a powder spray gun 205. As the spray gun 205 moves along the surface of the substrate 201, the portion of the substrate upon which the spray gun 205 is acting becomes hotter than other areas of the substrate 201. In this embodiment a sensor 203 provides temperature readings along the surface of the substrate 201, which are read by the PLC 207. The PLC 207, in turn, adjusts the adjustable valves 234, 236 to generate a cryogenic fluid spray profile, 209, that will provide additional cooling in the hottest area of the substrate 201 and less cooling in other areas. The PLC 207 will change the spray profile as the spray gun 205 moves along the substrate 201.

Alternatively, the PLC 207 could adjust the spray profile in response to signals from a position sensor (not shown ) that tracks the position of the spray gun 205 or the PLC 207 could be pre-programmed to follow a timed sequence of spray profiles which are synchronized with movement of the spray gun 205.

The cylindrical substrate 201 may, also, be a roll or another forming tool used for rolling metal or nonmetallic strip, profiling such strip and performing similar, continuous forming and shaping operations. The roll or the forming tool heats up during operation and picks undesired particulate debris on its surface. The spray bar 210 discharging the cryogenic fluid in a specific profile 209 may be used to blast clean the debris from the substrate surface and/or to cool the surface. For cleaning, anyone of the spray patterns from the nozzles shown in FIG. 6A-6I may be used. For some embodiments for cooling, it is preferred if the cryogenic fluid is applied from the nozzle of this invention by intensifying the spray of the fluid from the central portion of the nozzle and/or minimizing the flow of cryogenic fluid from the ends of the nozzle as shown in FIG. 6B or 6C to the substrate or roll to be cooled. During rolling and other forming operations, the central portion of the roll or other substrate is usually the hottest and ends of the roll or other substrate the coolest.

Figure 8:
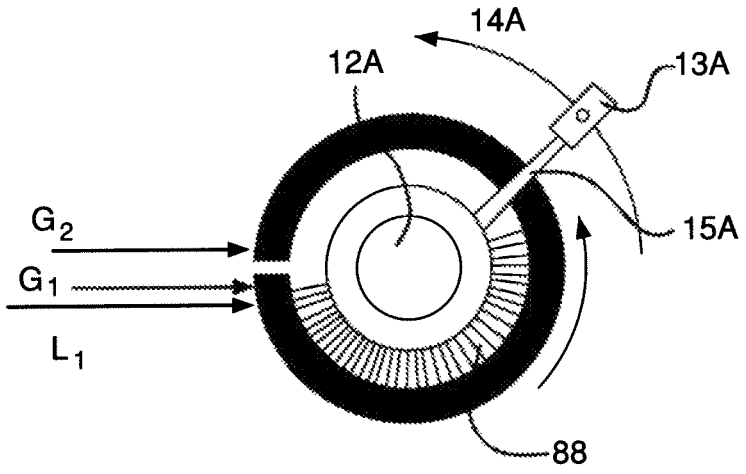
FIG. 8 shows another embodiment of the spray tube of FIG. 7 in which the spray tube encircles a substrate.

FIG. 8 shows a spray tube comprising a conduit that is wrapped into a circular shape which surrounds the substrate. In this embodiment, the spray profile 88 can be controlled to track the rotating hot spot 15A that is generated when the spray gun 13A circles or partially circles around the substrate part 12A in direction 14A.

Figure 9:
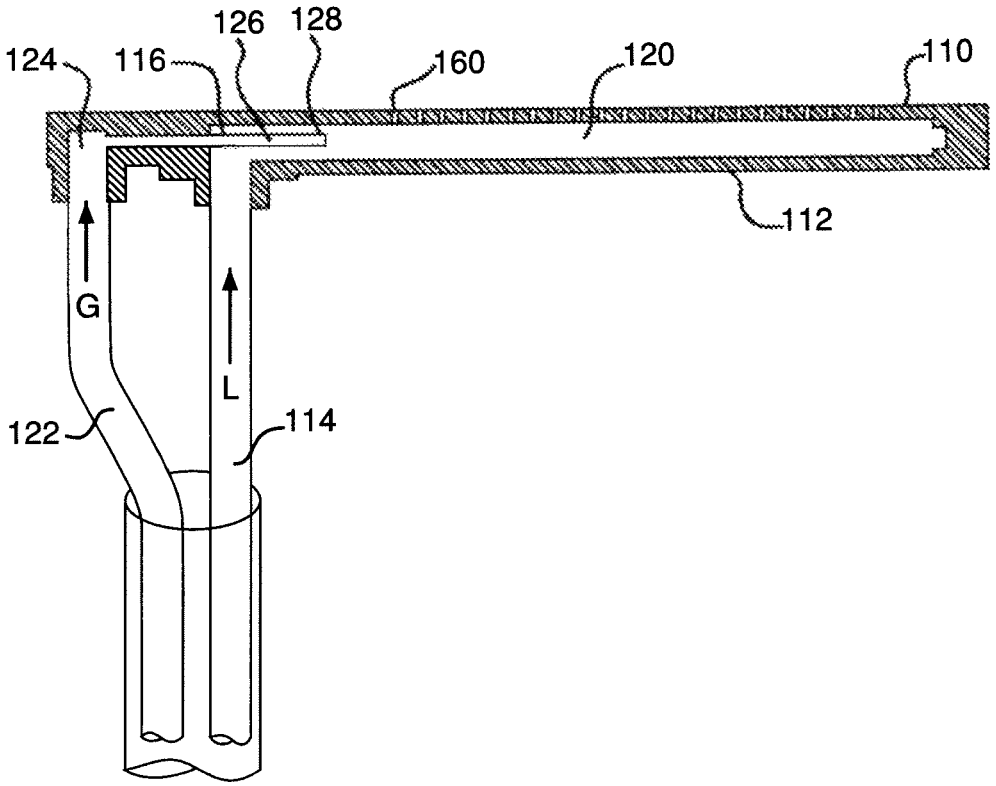
FIG. 9 shows another alternative spray tube embodiment.

Referring to FIG. 9, a tube-style spray apparatus 110 is shown, which is similar to the spray tube shown in FIG. 5 in that cryogenic liquid is discharged through openings 160 formed along the length of a conduit 112. Cryogenic liquid (preferably LIN) is supplied to the spray tube 110 by a conventional supply tube 114, then passes through a 90-degree elbow 116 and into a contact zone 120 within the conduit 112. Throttling gas is supplied by a supply tube 122 having a 90-degree elbow 124 and an injection tube 126 at its terminal end 128. The injection tube 126 extends past the elbow 116 of the cryogenic liquid supply tube 114 and into the contact zone 120, which enhances contact between the throttling gas and the cryogenic fluid.

This invention is not limited to the embodiments shown. Nozzles comprising multiple gas and liquid supply streams and lines can be used, and other modifications can be made to the embodiments shown, that are still within the scope of this invention.

The invention claimed is:

1. An apparatus comprising at least one spray device each comprising:

a contact zone for contacting a liquid (L) and a throttling gas (G) and forming a resulting fluid thereof;

at least one gas inlet in fluid communication with the contact zone for introducing the throttling gas into the contact zone;

at least one liquid inlet in fluid communication with the contact zone for introducing the liquid into the contact zone;

the contact zone being in fluid communication with at least one nozzle for discharging the resulting fluid through the at least one nozzle; and a gas supply control in fluid communication with each of the at least one gas inlet;

wherein the liquid is a cryogenic liquid and the at least one spray device is a spray device for the resulting fluid; and wherein the gas supply control adjusts the pressure of gas supplied to each of the at least one gas inlet to achieve a first desired flow rate of cryogenic liquid through the at least one nozzle when a source of cryogenic liquid at a first pressure is provided to each of the at least one cryogenic liquid inlet;

wherein the apparatus does not comprise a flow-restricting valve in fluid communication with the liquid inlet for controlling the flow rate of the cryogenic liquid, and wherein the flow rate of the cryogenic liquid is controlled as a function of the pressure of the throttling gas without any changes other than to the pressure of the throttling gas such that the ratio of the resulting fluid's liquid flow rate to gaseous flow rate ($D_L/D_G$) decreases with increasing pressure of the throttling gas.

2. The apparatus of claim 1, wherein the gas supply control comprises at least one adjustable valve, each of the at least one adjustable valve adjusts the pressure of the gas supplied to one of the at least one gas inlet to greater than the first pressure.

3. The apparatus of claim 1, wherein the at least one nozzle comprises a plurality of nozzles, each of the plurality of nozzles having a respective flow rate of cryogenic liquid, the flow rates of cryogenic liquid for each of the plurality of nozzles collectively defining a spray profile, wherein the gas supply control adjusts the pressure of gas supplied to each of the at least one gas inlet to achieve a first desired spray profile when a source of cryogenic liquid at the first pressure is provided to each of the at least one cryogenic liquid inlet.

4. The apparatus of claim 3, wherein the gas supply control comprises a controller that is programmed to change the spray profile in accordance with a preprogrammed cooling profile.

5. The apparatus of claim 3, wherein the gas supply control comprises a controller that is programmed to change the spray profile in response to signals received from a sensor.

6. The apparatus of claim 5, wherein the sensor comprises a temperature sensor that measures the temperature of at least a portion of a substrate being cooled by the at least one cryogenic spray device.

7. The apparatus of claim 1, wherein the at least one gas inlet comprises a first gas inlet and a second gas inlet.

8. The apparatus of claim 1, wherein the at least one cryogenic spray device comprises a plurality of cryogenic spray devices and the gas supply controller comprises a plurality of adjustable valves, each of the plurality of adjustable valves being in fluid communication with each of the at least one gas inlet.

9. The apparatus of claim 1 wherein the apparatus comprises:

an outer conduit;

an inner conduit positioned within the outer conduit and defining an annular space between the outer conduit and the inner conduit and the contact zone comprising the annular space, the inner conduit having at least one opening positioned to enable the cryogenic liquid to flow radially from the inner conduit into the annular space;

the at least one nozzle formed on the outer conduit, each of the at least one nozzle being in fluid communication with the annular space;

the at least one gas inlet in fluid communication with the outer conduit, wherein the at least one gas inlet is connected to a pressurized gas supply; and the at least one liquid inlet in fluid communication with the inner conduit, wherein the at least one liquid inlet is connected to a cryogenic liquid supply.

10. The apparatus of claim 9, wherein the at least one gas inlet is in head-on flow communication with the annular space.

11. The apparatus of claim 9, wherein the outer conduit includes a first end and a second end that is distal to the first end and comprises a second gas inlet, the at least one gas inlet being located at the first end and the second gas inlet being located at the second end, wherein the second gas inlet is connected to a pressurized gas supply.

12. The apparatus of claim 9, wherein the inner conduit and outer conduit are each cylindrical in shape and are concentric.

13. The apparatus of claim 9, wherein at least one nozzle comprises a plurality of nozzles arranged in a row.

14. A method comprising:

supplying a liquid at a first pressure and first temperature to a contact zone that is in fluid communication with at least one nozzle;

supplying a gas at a second pressure and second temperature to the contact zone, the second pressure being no less than the first pressure, the second temperature being greater than the first temperature, and the gas having a boiling point at 1 atm that is no greater than the first temperature;

contacting the liquid and the gas in the contact zone to provide a resulting fluid; and discharging the resulting fluid through the at least one nozzle, wherein the liquid is a cryogenic liquid, and wherein the second pressure of the gas supplied to the contact zone is regulated in order to achieve a desired flow rate of cryogenic liquid through each of the at least one nozzle;

wherein the method does not comprise controlling the supply of the cryogenic liquid to the contact zone with a flow-restricting valve, and wherein the flow rate of the cryogenic liquid is controlled as a function of the pressure of the throttling gas without any changes other than to the pressure of the throttling gas such that the ratio of the resulting fluid's liquid flow rate to gaseous flow rate ($D_L/D_G$) decreases with increasing pressure of the throttling gas.

15. The method of claim 14, wherein supplying the gas step further comprises regulating the second pressure greater than 1 to 100 times the first pressure in order to achieve the desired flow rate of cryogenic liquid through each of the at least one nozzle.

16. The method of claim 14, wherein supplying a gas at a second pressure and second temperature to the contact zone further comprises supplying the gas in a direction that impinges the cryogenic liquid being supplied to the contact zone.

17. The method of claim 14, wherein the supplying a cryogenic liquid step further comprises supplying a cryogenic liquid at a first pressure and first temperature to an inner conduit having at least one opening in fluid communication with the contact zone, the inner conduit being located within an outer conduit and the contact zone being located between the inner and outer conduits.

18. The method of claim 14, wherein the regulating the gas supplied step further comprises regulating the gas supplied to the contact zone using a controller that is programmed to adjust the pressure of gas supplied to the contact zone based on one or more of: (a) signals from at least one sensor and (b) a preprogrammed cooling profile.

19. The method of claim 14, wherein the method is used in one of the applications selected from the group of thermal spraying, welding; fusing; hardening; nitriding; carburizing; laser glazing; induction heat treating; brazing; extrusion; casting; finish-rolling; forging; embossing; engraving; patterning; printing, scribing or slitting of metal strip, tape, or tube; cryogenic cutting and grinding of metal and non-metal components; and processing, surfacing, or assembly in the metals, ceramics, aerospace, medical, electronics, and optical industries.

* * * * *